United States Patent [19]

Baus

[11] Patent Number: 4,606,081

[45] Date of Patent: Aug. 19, 1986

[54] PARTITION WALL STRUCTURE

[76] Inventor: Heinz G. Baus, Wartbodenstrasse 35, CH-3626 Hünibach-Thun, Switzerland

[21] Appl. No.: 779,637

[22] Filed: Sep. 24, 1985

[30] Foreign Application Priority Data

Sep. 29, 1984 [DE] Fed. Rep. of Germany ..... 3435905

[51] Int. Cl.[4] ..... A47K 3/4; A47K 3/08; A47K 3/22; A47K 3/14

[52] U.S. Cl. ..... 4/557; 4/607; 4/610

[58] Field of Search ..... 4/557, 558, 607, 608, 4/610, 611, 612

[56] References Cited

U.S. PATENT DOCUMENTS 4,090,265 5/1978 Baus ..... 4/607

FOREIGN PATENT DOCUMENTS 2554098 6/1977 Fed. Rep. of Germany .

*Primary Examiner*—Henry R. Artis

*Attorney, Agent, or Firm*—Schwartz, Jeffery, Schwaab, Mack, Blumenthal & Evans

[57] ABSTRACT

Partition wall structure, more particularly for bath or shower cubicles, has a displaceable door panel held against, magnetically at right angles to its longitudinal plane, and guided by the guide wall of a guide rail. The magnetic attraction is provided between a magnetic strip at the panel lower edge and another one on the guide wall, both being separated by an air-gap. The door panel includes a frame having enclosing members joined together by corner connectors. The air-gap is provided, at low structural cost, in order to ensure smooth guidance, and this is obtained by means of flat spacing strips formed on the corner connectors, these spacing strips preferably extending over the height of the guide wall associated therewith and/or of the door panel magnetic strip.

18 Claims, 4 Drawing Figures

PARTITION WALL STRUCTURE

FIELD OF THE INVENTION

The invention relates to a partition wall structure for use particularly in baths or shower cubicles; the structure having at least one displaceable door panel including a frame made out of frame members joined together by corner connectors; the door panel being held against, magnetically at right angles to its longitudinal plane, and guided by a guide wall of a guide rail, or the like, an air-gap being provided therebetween.

THE PRIOR ART

U.S. Pat. No. 4,090,265 of May 23, 1978, describes a partition wall structure comprising a plurality of door panels which are displaceable in relation to, or together with, each other, each being suspended from an upper sliding or roller guide rail. Also provided is a lower rail having guide walls in stepped formation. The guide walls and the adjoining door panels are separated by air-gaps and comprise magnetic strips producing a magnetic force at right angles to the longitudinal plane of the respective door panel. At least one of these magnetic strips is in the form of a permanent magnet which is mounted to face a magnetic return-circuit strip or a further permanent magnetic strip. The door panels comprise rollers that serve to provide an air-gap between the door panels and the guide walls. Because of the guide rollers, production and assembly costs are high because of the quite close tolerances that must be observed. In a very unfavourable case, the various tolerances in the rollers, the bearings thereof and the pick-up devices in the door panels could accumulate, causing the air-gap to disappear. Under other circumstances, the gap could be too large. In the first case, a large transverse magnetic force would mean that the door would require a correspondingly large force to move it whereas, in the other case, correct installation and guidance could no longer be assured. Furthermore, the components take up more space and add weight, thus increasing the cost of procuring and assembling the different components. It is also indicated in the above U.S. patent that the magnetic strips, i.e. the permanent magnets and possibly the armature parts associated therewith, should be coated with a synthetic material in order to reduce sliding friction in the event of failure of the guide rollers. However, direct support of the parts, as proposed in this patent, has been found, in practice, to be by no means desirable, since dirt, damages to the synthetic material surfaces, and penetration of water all mean that the properties of the materials do not remain constant over the life of the unit. Smooth operation of the door panels cannot be assured with the necessary reliability over an extended period of time. Difficulties also arise as a result of the difference in thermal expansion between the magnetic strips, on the one hand, and the guide rail and frame rail member on the other hand. If the magnetic strips are mounted in longitudinal grooves in the guide rail or in the lower frame member, there is a danger of the ends of the magnetic strips leaving the grooves and thus considerably impairing the serviceability of the partition wall as a whole.

OBJECTS OF THE INVENTION

It is therefore an object of the invention to provide a partition wall structure, of the type mentioned above, at low structural cost and so that the door panels run smoothly and that this continues over an extended service life. Little force is required to operate the door panels. Outside factors, such as heat, moisture, dirt, etc. have little effect upon smooth operation. The parts required for magnetic guidance take up little space and are light in weight, while production is rapid and inexpensive. Furthermore, by reliable location of the magnetic strip in a groove, or the like in the lower frame member of the door panel, a long service-life and a high degree of reliability are achieved.

In order to accomplish the above objects, the air-gaps are obtained by providing spacing strips on the corner connectors, the spacing strips extending preferably at least over the entire height of the guide wall associated therewith and/or of the magnetic strip. The connector spacing strips take up little space, add little weight, but ensure that comparatively narrow air-gaps are maintained so that, at little cost in magnetic material, a large transverse force is obtained whereas, on the other hand, direct bearing and holding of the permanent magnets together is eliminated. Thus even after extended use, the door panel can still be moved as necessary, with little force.

The magnetic strips of the door panels may be in the form of permanent magnets, magnetic return-circuit parts, or armature parts. The magnetic strips of the door panels and of the associated guide walls, which face each other at right angles to the plane of the door panels, are preferably disposed in open longitudinal grooves, their surfaces facing each other but maintaining the aforesaid air-gaps. The magnetic strips are inserted into the longitudinal grooves and are glued therein, thus simplifying production.

In one particularly practical embodiment, the spacing strips and webs of the corner connectors engage over the ends of the lower horizontal frame member and/or of the magnetic strips. The spacing strips and webs close off the frame member satisfactorily, thus preventing the entry of any dirt. The ends of the magnetic strip are also held by the spacing strips in the lower frame member. Thus even after extended use, the ends of the magnetic strip, or of the permanent magnet, cannot project from the end of the lower frame member and thus be torn out or fall out when the door panel is moved. Finally, production tolerances and/or sharp edges on the permanent magnet, or on the lower frame member are covered in a particularly simple manner, thus preventing the entry of dirt and improving the appearance of the door panel. Furthermore, by engaging over the ends of the magnetic strip, the spacing strips ensure that changes in length, arising from different coefficients of thermal expansion between the magnetic strips, on the one hand, and the lower frame member on the other hand, is not detrimental. Over a long service-life, the ends of the magnetic strip is also prevented from bulging due to the ingress of dirt etc. in conjunction with thermal expansion, which would result in the magnetic strip being torn out of the groove in the lower frame member when the door is moved.

According to a preferred feature, in order to achieve simple and inexpensive production, the spacing strips and the corner connectors are made in one piece, preferably out of plastic. This one-piece design also provides an appreciable advantage from the point of view of assembly, since this means that the spacing strips and the corner connectors are applied to the door panel in a single operation.

According to another preferred feature, the corner connectors each comprises a stud engaging in a cavity in the lower frame member, the said cavity being located behind the permanent magnet. This stud ensures reliable alignment of the corner connector, and of the spacing strips, in relation to the lower frame member. Even if production tolerances are taken into account, the spacing strips therefore always bear against the surface, associated with the guide wall, of the guide rail, thus eventually ensuring the exact setting of the air-gap.

The guide wall, and/or the lower frame member, may comprise an open longitudinal channel for the magnetic strip or strips. The permanent magnets, or the return-circuit parts which face each other on the guide wall and door panel, thus face each other directly, only the previously mentioned air-gap being between the said permanent magnets or between the return-circuit part and the permanent magnet.

In order to obtain, between the frame member of the door panel, a connection which is particularly easy to produce but is still functional, it is furthermore an object that the lower frame member comprise a longitudinal channel for a further corner connector stud and/or an extension, a threaded channel, more particularly for a single attachment element, being provided between the web or the extension. The attachment element, more particularly in the form of a screw, engages through a transverse hole in the vertical frame member of the door panel, which is connected to the lower frame member. Thus, the connection between the two frame members, and the attachement of the strip joined to the corner connector, is effected in a single operation. This requires extremely little time and the resulting cost advantages are obvious. The attachment element passes through a transverse hole in the vertical frame member of the door panel. Furthermore, the attachement element is introduced, jointly with the above-mentioned stud, into the longitudinal channel in the lower horizontal frame member. The corner connector, preferably made of plastic, may be produced inexpensively, making possible, with a single connecting element, an extremely reliable joint between the horizontal and the vertical frame members of the door panel. At the same time, by reason of the spacing strips and possibly the webs, the corner connector ensures reliable closure of the frame members, thus almost eliminating the entry of water, dirt, etc. into the interior. Simple sealing of the ends of the frame members is similarly achieved.

According to still another embodiment, the corner connector comprises an extension projecting over the end of the lower frame member, the vertical front edge of which is substantially in alignment with the outer edge of the vertical frame side member. At a cost of little material, this provides an attractive and practical closure for the lower frame member, and an adequate seal to deal with possible spray. The extension proposed is appreciably narrower than the frame member, and this again saves material.

In one particularly interesting embodiment, the corner connector and/or the lower frame member comprises a leg pointing downwardly and into the inside of the shower cubicle, the leg preventing, in a particularly simple manner, the escape of spray from the cubicle by carrying water, soap residues, etc. running from the inside of the door panel, into the interior and into the shower tub, thus not inconsiderably reducing the danger of dirt in the vicinity of the magnetic strip. In addition to this, at least the lower frame member may contain, between the said leg and the lower edge, an upwardly directed recess, so that water flowing away can always run down the leg.

SUMMARY OF THE INVENTION

The invention is an improvement in a partition wall structure having at least one vertically suspended slidable wall panel which is provided with a bordering frame having a lower horizontal frame member joined, at the ends thereof, by corner connectors to vertical frame members, the lower frame member having a vertical outer surface. The structure further has an elongated lower guide member defining a vertical guiding wall surface which is constantly facing the lower frame outer surface as well as the corner connectors when the door panel is being displaced. The structure additionally has magnet means including a first part which is mounted on the lower frame member and which has an outward face flush with the lower frame outer surface as well as a second part mounted on the guide member so as to have an outward face which is flush with the guiding wall surface. The improvement according to the invention essentially lies in the provision of gap-defining means for holding the outward faces of the magnet parts spaced a predetermined distance from one another. This gap-defining means comprises spacing strips solid with the connectors and overlapping the ends of the first part of the magnet means over a portion of its outward face so as to hold it at a predetermined distance away from the second part during displacement of the slidable wall panel and against a magnetic force which develops between the magnet parts.

A description of a preferred embodiment of the invention now follows having reference to the appended drawings.

DESCRIPTION OF THE PREFERRED EMBODIMENT

Figure 1:
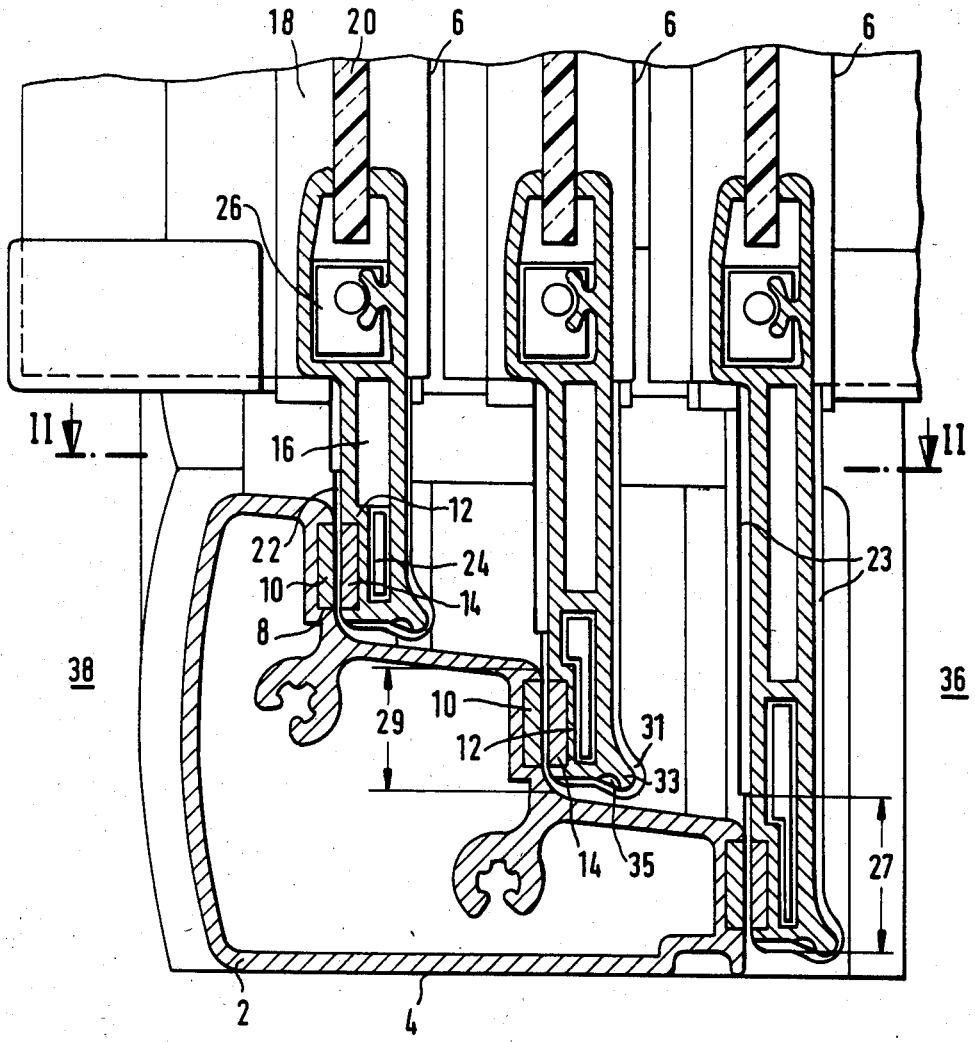
FIG. 1 is a cross-section through the lower part and at a lower corner of a shower partition wall structure comprising three door panels staggered in relation to each other.

FIG. 1 shows the lower part of the structure to comprise a lower horizontal guide rail 2 having a bottom 4 intended to rest, in the usual manner, upon a shower tub, or the like, not shown. This lower guide rail 2 is a part of a frame including a horizontal upper guide rail from which are suspended in known fashion, three door panels 6, displaceable in their longitudinal direction, i.e. at right angles to the plane of FIG. 1. Lower guide rail 2 is stepped and forms a guide wall 8 for each of the three door panels 6. A magnetic strip 10, in the form of a permanent magnet, is mounted in each guide wall 8 in an open longitudinal groove. Similarly, further magnetic strips 14 also in the form of permanent magnets, are mounted, each on the lower profiled frame side member 12 of a door panel 6, facing a corresponding permanent magnet 10. The latter magnets may also be replaced by a single permanent magnet located either in the door panel 6 or in the guide wall 8 and by a magnetic return-circuit part facing it. Located at each of the lower corners of a door panel 6 is a corner connector 16 which joins a horizontal lower frame member 12 with an adjacent vertical side frame member 18 of a door panel. The frame members 12 and 18, and an upper horizontal frame member, not shown here, constitute a frame for the accommodation of a panel 20 made of transparent synthetic material.

Each corner connector 16 is formed with a spacing strip 22 serving to define an air-gap between the magnetic strips or permanent magnets 10 and 14 which face each other. Located behind the permanent magnet 14, in the lower frame member 12, is a corner connector stud 24. Corner connector 16 is made in one piece with the spacing strip 22, the stud 24 and an additional stud 26, to be referred to again hereinafter, preferably of plastic. Stud 24 ensures alignment between the spacing strip 22, and the lower frame member having the permanent magnet 14. Spacing strip 22 thus always projects, to a predetermined distance, beyond the vertical surface of the lower frame member 12 and of the door permanent magnet 14 arranged therein, the air-gap being defined between permanent magnets 10 and 14 directly facing each other. Permanent magnets 10 and 14 are each located in longitudinal grooves in the guide wall 8 of the lower guide rail 2 and in the lower frame side 12. Permanent magnets 14 extend beyond the full length of the lower frame side 12 and are covered at their ends by spacing strips 22 of corner connectors 16. Thus, by means of the corner connectors 16 and the spacing strips 22, the ends of the permanent magnets 14 are prevented from being removed, in a particularly simple manner.

Each corner connector 16 also comprises webs 23 likewise engaging over the end of the lower frame member 12. By means of the webs 23, in conjunction with the spacing strips 22, the lower frame member 12 together with the ends thereof, are closed off. Each spacing strip 22 is of a height 27 (FIG. 1) which is equal to, or greater than, the height 29 of the respective guide wall 8. The advantage of this is that, even if the vertical adjustment of a door panel 6 varies, correct guidance is always assured. Each corner connector 16 comprises a leg 31, while the lower horizontal frame side 12 has a corresponding leg 33. Legs 31 and 33 point downwardly, toward the inside 36 of the shower cubicle. Thus water running off a door element 6 is guided safely to the inside 36. Furthermore, by means of legs 33 and also 31, the distances between the inclined steps in guide rail 2 are appreciably reduced, thus reliably preventing spray from escaping, into the outside 38 of the cubicle. Provided in the transition area to leg 33 in frame member 12 is an upwardly directed recess 35. Thus water flowing down a door panel 6 cannot reach the lower edge in the direction of cubicle outside area 38, nor of the magnetic strips. The danger of lime, soap residues, etc. building up in the vicinity of the magnetic strips is thus considerably reduced.

Figure 2:
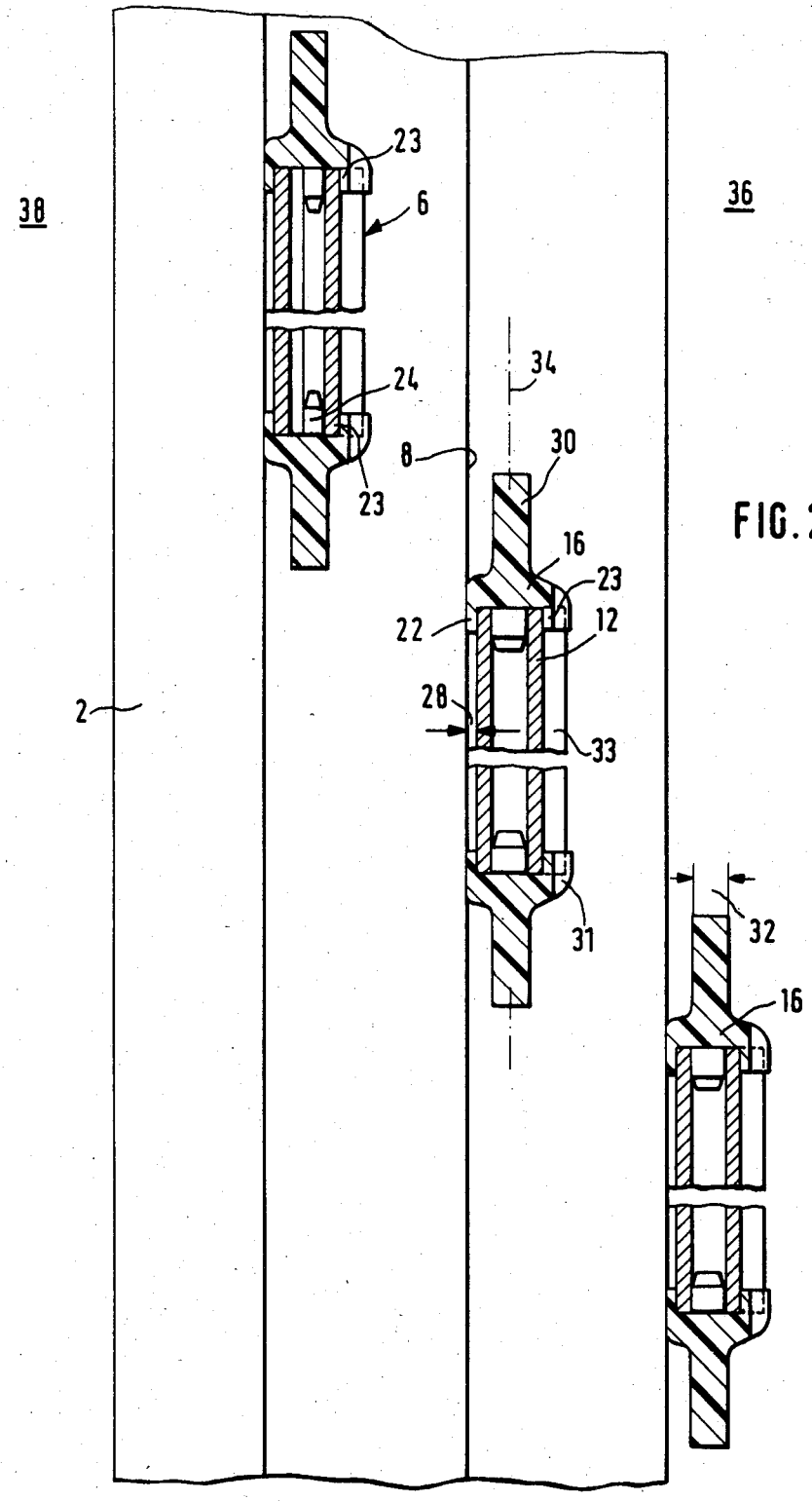
FIG. 2 is a cross-section along line II—II in FIG. 1.

FIG. 2 is a cross-section along the line II—II in FIG. 1 in which, for reasons of clarity, the door panels are not shown in full length in the direction of the lower guide rail 2. Spacing strips 22 and webs 23 engage over the ends of the lower frame members 12, width 28 of the air gap between guide wall 8 and frame member 12 being determined by the spacing strips 22. It should be recalled that the magnetic strips 10, 14, as fitted, lie with their surfaces flush with the guide wall 8 and the lower frame member 12, respectively, so that the width 28 (FIG. 2) of the air-gap is identical with the air-gap between the permanent magnets, not shown here for the sake of clarity. Also visible here are studs 24 of corner connectors 16. Again for reasons of clarity, the transverse webs according to FIG. 1 are not shown in the two door panels 6 to the right of the figure. These studs 24 ensure satisfactory location of corner connectors 16 and accurate alignment of spacing strips 22 in relation to lower frame member 12. Door panels 6 are shown here considerably shortened in their longitudinal direction; legs 33, pointing in the direction of the inside 36 of the cubicle, being clearly visible, as are legs 31 of the corner connector 16 directed accordingly toward the inside 36 of the cubicle.

Each corner connector 16 is further provided with an extension 30 acting as extension of the adjacent vertical frame member projecting upwardly in the vertical direction. This extension 30 has a thickness 32 which is considerably less than that of the lower frame member 12. Extension 30 needs less material.

The three door panels 6 are guided on the lower member 2 in staggered relationship with each other, the closed position being shown in FIG. 1. The permanent magnets exert upon each door panel 6 a force component at right angles to the longitudinal flat plane 34 of the door panel. Suitable polarity of the magnets provides the desired magnetic attraction between permanent magnets which face each other. Extensions 30 also prevent spray from passing from the inside 36 of a shower to the outside 38, since in the closed position of door panels 6 shown, extensions 30 on adjacent door panels are at substantially the same height.

Figure 3:
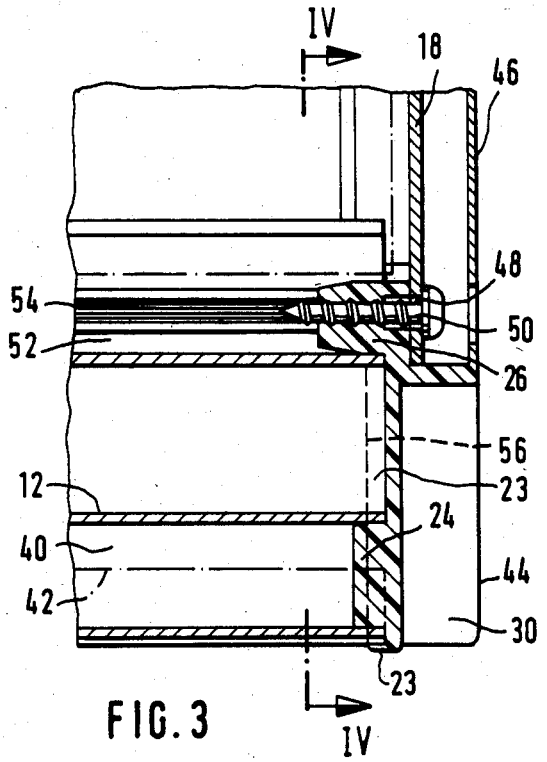
FIG. 3 is a cross-section through a lower corner of a door panel in the longitudinal plane thereof.

FIG. 3 shows a cross-section through the longitudinal general flat plane of the central door panel according to FIG. 1. Lower frame member 12 comprises a cavity 40, extending in the longitudinal direction, in which stud 24 is inserted. The permanent magnet 14 of the door panel is shown by broken lines 42. Vertical front edge 44 of extension 30 is in alignment with the vertical outer edge of the vertical frame member 18. Extension 30 thus closes off vertical frame member 18 at the bottom. The latter member 18 is formed with a transverse hole 48 for an attachment element 50, in the form of a screw, passing through it. The connection is effected by a stud 26 of the corner connector 16 engaging in a longitudinal channel 52 in lower frame member 12. Located on a web 58 in channel 52 are lateral extensions 54 which form a threaded channel with the part of the stud 26 associated therewith. Attachment element 50, or screw, engages with its thread both in stud 26 and in the surface of the threaded lateral extensions 54, thus effecting mutual connection. As may be seen, vertical frame member 18 is positioned by means of the head of the screw 50. Broken line 56 indicates the web 23 and the spacing strip 22 which engages over the end of the permanent magnet 14 shown by dotted line 42. The spacing strip reliably prevents release of the end of the permanent magnet 14.

Figure 4:
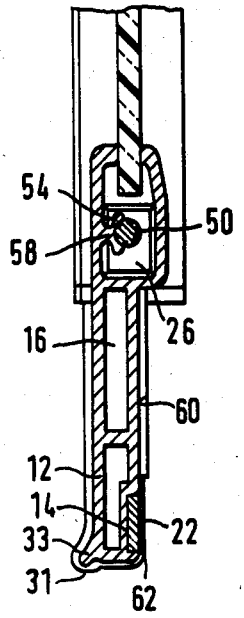
FIG. 4 is a cross-section along line IV—IV in FIG. 3.

FIG. 4 shows how screw 50 engages in a threaded channel between lateral extensions 54 and stud 26. Extensions 54 are provided on the web 58 of lower frame member 12. Strip 22 projects for a specific distance beyond the free right-hand surface of the permanent magnet 14 as shown in FIG. 2. Outer surface 62 (FIG. 4), of the magnetic strip and permanent magnets 14, lies in the same vertical plane as the vertical edge surface 60 of the lower frame member 12. Projecting edges, which could encourage the build-up of lime or dirt or promote the release of the magnetic strip, are avoided. By means of spacing strips 22 an extremely small air-gap is obtained between the magnetic strip of the door panel and the associated magnetic strip on the lower frame member.

I claim:

1. A partition wall structure having at least one vertically suspended slidable wall panel provided with a bordering frame having a lower horizontal frame member joined, at the ends thereof, by corner connectors to vertical frame members, said lower frame member having a vertical outer surface; said structure further having an elongated lower guide member defining a vertical guiding wall surface constantly facing said lower frame outer surface and said connectors during displacement of said door panel; said structure additionally having magnet means including a first part mounted on said lower frame member and having an outward face flush with said lower frame outer surface and a second part mounted on said guide member so as to have an outward face flush with said guiding wall surface, the improvement therewith in the provision of gap-defining means holding said outward faces of said magnet parts spaced a predetermined distance from one another, said gap-defining means comprising:

spacing strips solid with said connectors and overlapping the ends of said first part of said magnetic means over a portion of said outward face of said first part so as to hold said first part outward face at said predetermined distance away from said second part during displacement of said slidable wall panel and against a magnetic force developing between said magnet part.

2. A structure as claimed in claim 1, wherein said spacing strips extend vertically over a height greater than the vertical width of said first part.

3. A structure as claimed in claim 1, wherein said spacing strips extend vertically over a height greater than the height of said guiding wall surface.

4. A structure as claimed in claim 2, wherein said first part of said magnet means is an elongated strip that extends essentially the full length of said lower frame member and said second part is an elongated strip that extends essentially the full length of said guide wall.

5. A structure as claimed in claim 1, wherein said spacing strips and said corner connectors form single members.

6. A structure as claimed in claim 5, wherein said single members are made of plastic material.

7. A structure as claimed in claim 1, wherein said lower frame member is formed with cavities at the ends thereof and said corner connectors comprise studs each inserted into one of said cavities.

8. A structure as claimed in claim 7, wherein said cavities are located behind said magnet first part.

9. A structure as claimed in claim 4, wherein said lower frame member is formed with an elongated groove opening toward said guide wall and said elongated strip making up said first magnet part is housed within said groove from the opening thereof.

10. A structure as claimed in claim 4, wherein said guide wall is formed with an elongated groove opening toward said lower frame member and said elongated strip making up said second part is housed within said groove from the opening thereof.

11. A structure as claimed in claim 7, wherein said lower frame member is formed with further cavities at the ends thereof above said first mentioned cavities; said connectors comprise further studs each inserted into one of said further cavities; means within said further cavities and further studs defining threaded channels therebetween; wherein said frame vertical members are formed with transverse holes at the lower ends thereof and screws extending across said holes and threaded into said threaded channels to secure said vertical frame members to said lower horizontal frame members through said connectors, said screws having heads applying against said vertical frame members around said transverse holes thereof.

12. A structure as claimed in claim 11, wherein each of said connectors has a downward extension having an outer edge in alignment with the outer edge of the vertical frame member to which it is connected and having a thickness smaller than that of the lower horizontal frame member to which it is connected.

13. A structure as claimed in claim 12, wherein said lower horizontal frame member is formed at the lower edge thereof with water deflecting legs turning away from said guide member.

14. A structure as claimed in claim 13, wherein said extensions of said connectors terminate, at their lower ends, into water deflecting legs turning away from said guide member and in alignment with said legs of said lower frame member.

15. A structure as claimed in claim 3, wherein said first part of said magnet means is an elongated strip that extends essentially the full length of said lower frame member and said second part is an elongated strip that extends essentially the full length of said guide wall.

16. A structure as claimed in claim 1, wherein said spacing strips extend vertically over a height greater than the vertical width of said first part and greater than the height of said guiding wall surface, and wherein said first part of said magnet means is an elongated strip that extends essentially the full length of said lower frame member and said second part is an elongated strip that extends essentially the full length of said guide wall.

17. A structure as claimed in claim 16, wherein said lower frame member is formed with an elongated groove opening toward said guide wall and said elongated strip making up said first magnet part is housed within said groove from the opening thereof and said corner connectors extend over the end edges of said lower frame member strip and close off said lower frame member groove.

18. A structure as claimed in claim 1, wherein said first part of said magnet means is an elongated strip that extends essentially the full length of said lower frame member and said second part is an elongated strip that extends essentially the full length of said guide wall and wherein said corner connectors extend over the end edges of said strip of said lower frame member and close off said groove of said lower frame member.

* * * * *